US009668311B1

(12) United States Patent
Chen

(10) Patent No.: US 9,668,311 B1
(45) Date of Patent: May 30, 2017

(54) INTEGRATED CIRCUITS FOR AC LED LAMPS AND CONTROL METHODS THEREOF

(71) Applicant: Analog Integrations Corporation, Hsin-Chu (TW)

(72) Inventor: Wei-Ming Chen, Hsin-Chu (TW)

(73) Assignee: Analog Integrations Corporation, Hsin-Chu (TW)

( * ) Notice: Subject to any disclaimer, the term of this patent is extended or adjusted under 35 U.S.C. 154(b) by 0 days.

(21) Appl. No.: 15/284,559

(22) Filed: Oct. 4, 2016

(51) Int. Cl.
*H05B 37/02* (2006.01)
*H05B 33/08* (2006.01)

(52) U.S. Cl.
CPC ..... *H05B 33/0842* (2013.01); *H05B 33/0809* (2013.01); *H05B 33/0887* (2013.01)

(58) Field of Classification Search
CPC ..... H05B 33/0833; H05B 33/0845
USPC .... 315/185 R, 209 R, 227 R, 291, 308, 294, 315/295, 297, 299, 301
See application file for complete search history.

(56) References Cited

U.S. PATENT DOCUMENTS 7,081,722 B1 * 7/2006 Huynh ..... H05B 33/0818 315/185 S
7,439,944 B2 * 10/2008 Huynh ..... H05B 33/0818 315/185 S
9,374,863 B2 * 6/2016 Wang ..... H05B 33/083
2012/0081032 A1 * 4/2012 Huang ..... H05B 33/0815 315/294
2014/0015430 A1 * 1/2014 Kurt ..... H05B 33/083 315/193

* cited by examiner

*Primary Examiner* — Thuy Vinh Tran
(74) *Attorney, Agent, or Firm* — Winston Hsu; Scott Margo

(57) ABSTRACT

An integrated circuit is suitable for use in an AC LED lamp and is configured to control a power bank coupled between a rectified input voltage and a ground voltage. The AC LED lamp has LED groups arranged in series between the rectified input voltage and the ground voltage. The power bank has a capacitor storing electric energy and a discharge switch coupled between the capacitor and the rectified input voltage. The integrated circuit has a path controller and a bank controller. The path controller controls conduction paths, each coupling a corresponding LED group to the group voltage. The bank controller turns on the discharge switch in response to a first path signal corresponding to a first conduction path, and turns off the discharge switch in response to a second path signal corresponding to a second conduction path. The first and second path signals are different from each other.

21 Claims, 6 Drawing Sheets

INTEGRATED CIRCUITS FOR AC LED LAMPS AND CONTROL METHODS THEREOF

BACKGROUND OF THE INVENTION

1. Field of the Invention

The present disclosure relates generally to Light-Emitting Diode (LED) lamps, and more particularly to integrated circuits for Alternating Current (AC) driven LED lamps and control methods thereof.

2. Description of the Prior Art

Light-Emitting Diodes or LEDs are increasingly being used for general lighting purposes. In one example, a set of LEDs is powered from an AC power source and the term "AC LED" is sometimes used to refer to such circuit. Concerns for AC LED include manufacture cost, power efficiency, power factor, flicker, lifespan, etc.

U.S. Pat. No. 9,374,863 demonstrates several AC LED lamps, and is incorporated by reference herein in its entirety. FIG. 1 duplicates an AC LED lamp 100 disclosed in U.S. Pat. No. 9,374,863, and could have the ability of eliminating a dark period that possibly appears when the AC power source is low in amplitude. AC LED lamp 100 could be flick-free.

In FIG. 1, an integrated circuit 102 has path switches $SG_1$, $SG_2$, $SG_3$ and $SG_4$, a path controller 24, and a bank controller 106. Each of path switches $SG_1$, $SG_2$, $SG_3$ and $SG_4$ provides a conduction path and connects one cathode of an LED group to a current source 25, which limits the maximum driving current from the LED string to the ground voltage. For example, the conduction path that the path switch $SG_1$ controls connects the cathode of the LED group $\mathbf{20}_1$ and the current source 25. The path controller 24 is configured to adaptively control the path switches $SG_1$, $SG_2$, $SG_3$ and $SG_4$. For example, if the rectified input voltage $V_{REC}$ is so low that the current $I_{G4}$ passing through the LED group $\mathbf{20}_4$ is about 0 A, then the path controller 24 turns on the path switch $SG_3$, coupling the cathode of the LED group $\mathbf{20}_3$ directly to the current source 25.

A pulse generator 108 in FIG. 1 is configured to respond to signal $S_1$ which the path controller 24 sends to control the path switch $SG_1$, the most upstream path switch among all the path switches. When the signal $S_1$ is asserted to turn on the path switch $SG_1$, the pulse generator 108 is triggered to output a pulse $S_{CONN}$ with a predetermined pulse width. The pulse $S_{CONN}$ turns on the switch 116 such that the constant current source 118 conducts the control current $I_{CTL}$ from the base of the BJT 110. The pulse generator 108 determines the pulse width of the pulse $S_{CONN}$, referred to as a connection period $T_{CONN}$ in this specification because the BJT 110 seemingly connects the capacitor 112 to the node REC when the pulse $S_{CONN}$ appears. The electric energy stored by the capacitor 112 in the power bank 104 could be released to power the LED groups $\mathbf{20}_1$, $\mathbf{20}_2$, $\mathbf{20}_3$ and $\mathbf{20}_4$ during the connection period $T_{CONN}$, so as to keep some of the LED groups $\mathbf{20}_1$, $\mathbf{20}_2$, $\mathbf{20}_3$ and $\mathbf{20}_4$ illuminating when the input voltage $V_{AC}$ across an input port 16 is low in amplitude.

SUMMARY OF THE INVENTION

In an embodiment of the present invention, an integrated circuit is suitable for an LED lamp. The LED lamp comprises a power bank and LED groups. The power bank is coupled between a rectified input voltage and a ground voltage, and the power bank comprises a capacitor storing electric energy and a discharge switch coupled between the capacitor and the rectified input voltage. The LED groups are arranged in series between the rectified input voltage and the ground voltage. The integrated circuit comprises a path controller and a bank controller. The path controller is configured to control conduction paths, and each conduction path couples a corresponding LED group to the ground voltage. The bank controller is configured to turn on the discharge switch in response to a first path signal corresponding to a first conduction path, and to turnoff the discharge switch in response to a second path signal corresponding to a second conduction path. The first and second path signals are different from each other.

In an embodiment of the present invention, a control method is suitable for an LED lamp. The LED lamp comprises a power bank and LED groups. The power bank is coupled between a rectified input voltage and a ground voltage, and the power bank comprises a capacitor storing electric energy and a discharge switch coupled between the capacitor and the rectified input voltage. The LED groups are arranged in series between the rectified input voltage and the ground voltage. The control method comprises: providing conduction paths, each coupling a corresponding LED group to the ground voltage; turning on the discharge switch in response to a first path signal corresponding to a first conduction path among the conduction paths, so as to release the electric energy to power the LED groups; and turning off the discharge switch in response to a second path signal corresponding to a second conduction path among the conduction paths, so as to stop the capacitor from releasing the electric energy. The first and second path signals are different from each other.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

The invention can be more fully understood by the subsequent detailed description and examples with references made to the accompanying drawings, wherein.

DETAILED DESCRIPTION

The following embodiments are described in sufficient detail to enable those skilled in the art to make and use the invention. It is to be understood that other embodiments would be evident based on the present disclosure, and that improves or mechanical changes may be made without departing from the scope of the present invention.

In the following description, numerous specific details are given to provide a thorough understanding of the invention. However, it will be apparent that the invention may be practiced without these specific details. In order to avoid obscuring the present invention, some well-known configurations and process steps are not disclosed in detail.

Figure 1:
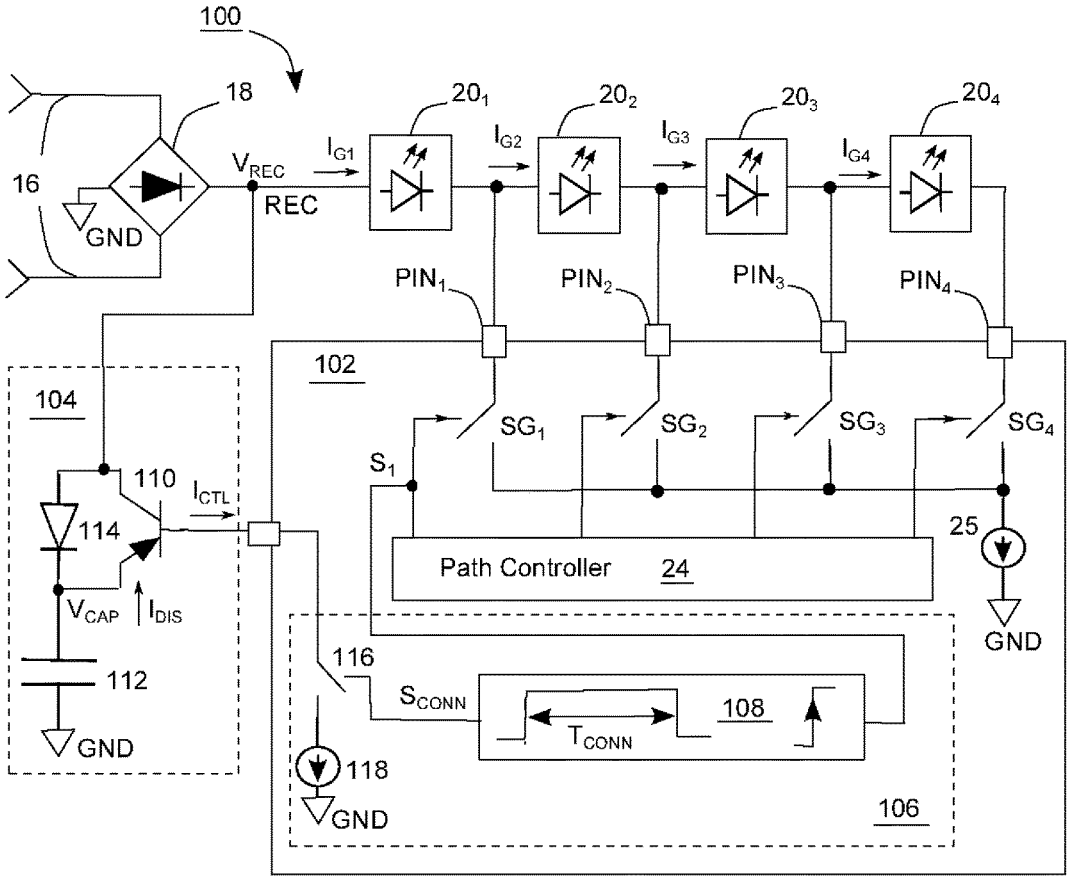
FIG. 1 (PRIOR ART)
FIG. 1 demonstrates an AC LED lamp in the art.

In FIG. 1, the connection period $T_{CONN}$ is a constant, determined by the pulse generator 108. This fixed length of the connection period $T_{CONN}$ is difficult to optimize, however. A too-short connection period $T_{CONN}$ could early stop supplying the power of the capacitor 112 to the LED string, unable of eliminating the dark period completely. A too-long connection period $T_{CONN}$, in the other hand, could render the capacitor 112 still in connection with the node REC when the magnitude of the input voltage $V_{AC}$ has passed a peak and starts falling, resulting in inefficient operation of the capacitor 112 because the voltage of the capacitor 112 unnecessarily decreases before the beginning of the connection period $T_{CONN}$.

Therefore, it is preferred that the connection period $T_{CONN}$ could automatically adapt itself based on the configuration of a LED lamp.

Figure 2:
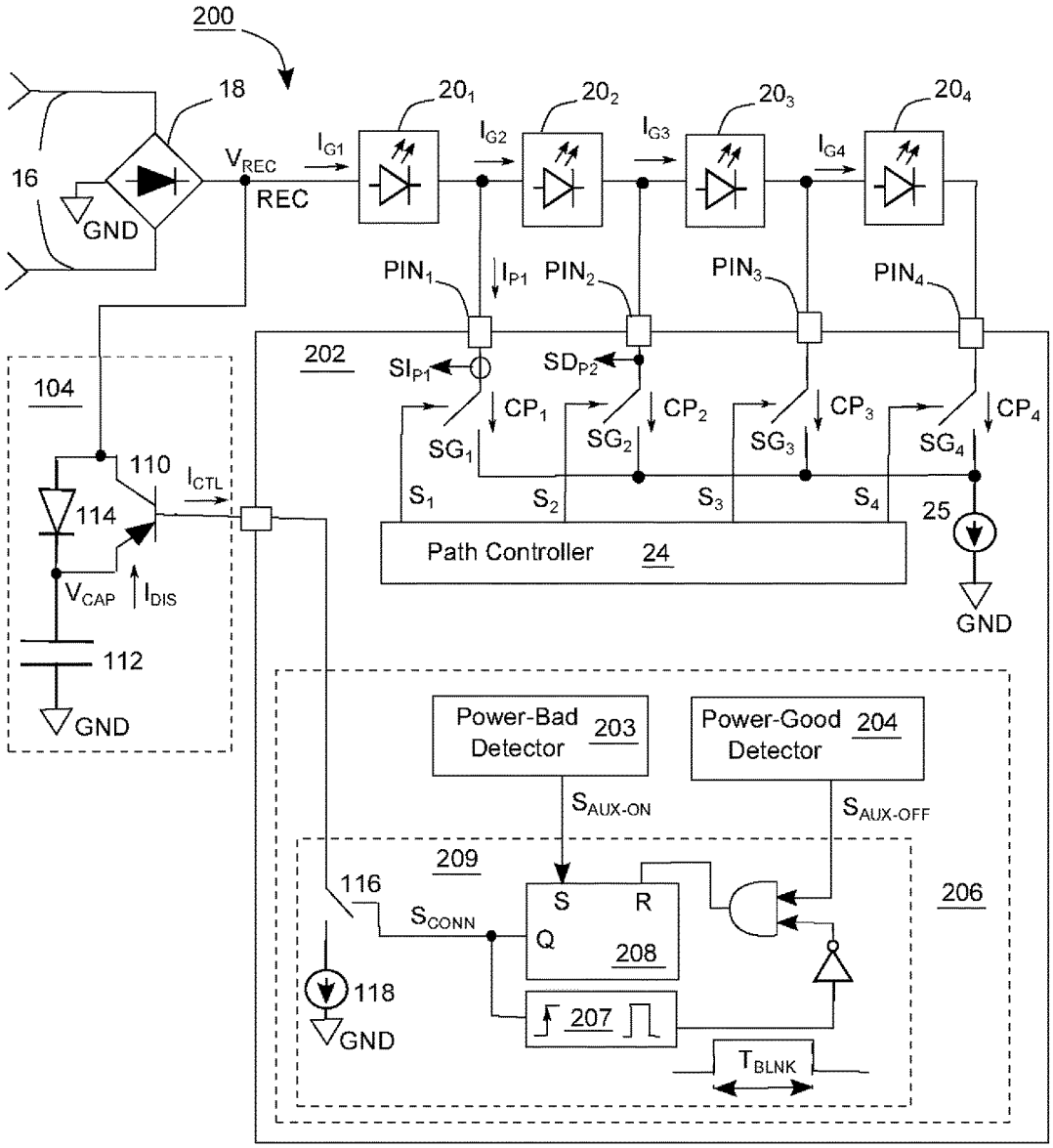
FIGS. 2, 3, 4 and 5 demonstrate AC LED lamps according to embodiments of the invention.

FIG. 2 demonstrates an AC LED lamp 200 according to embodiments of the invention. The AC LED lamp 200 has a full-wave rectifier 18 to rectify a sinusoid input voltage $V_{AC}$ across an input port 16, and provides a rectified input voltage $V_{REC}$ at node REC and a ground voltage at node GND. The LED groups $\mathbf{20}_1$, $\mathbf{20}_2$, $\mathbf{20}_3$ and $\mathbf{20}_4$ form a LED string and are connected in series between the rectified input voltage $V_{REC}$ and the ground voltage. Each LED group might consist of several LEDs connected in parallel or in series, depending on its application. The LED group $\mathbf{20}_1$ is the most upstream LED group in FIG. 2 as its anode is connected to the highest voltage in the LED string, the rectified input voltage $V_{REC}$. Analogously, the LED group $\mathbf{20}_4$ is the most downstream LED group among the LED groups in FIG. 2. The LED group $\mathbf{20}_2$ is a downstream LED group in respect to the LED group $\mathbf{20}_1$ and an upstream LED group in respect to the LED group $\mathbf{20}_3$.

An integrated circuit 202, possibly in form of a packaged chip, has path switches $SG_1$, $SG_2$, $SG_3$ and $SG_4$, a path controller 24, and a bank controller 206. Each of path switches $SG_1$, $SG_2$, $SG_3$ and $SG_4$ provides a conduction path connecting the cathode of a corresponding LED group to a current source 25, which limits the maximum driving current from the LED string to the ground voltage. For example, the path switch $SG_1$ provides and controls the conduction path $CP_1$ between the cathode of the LED group $\mathbf{20}_1$ and the current source 25. The path controller 24 is configured to adaptively control the path switches $SG_1$, $SG_2$, $SG_3$ and $SG_4$. For example, if the rectified input voltage $V_{REC}$ is so low that the current $I_{G4}$ passing through the LED group $\mathbf{20}_4$ is about 0 A, then the path controller 24 turns on the path switch $SG_3$, providing the conduction path $CP_3$ to couple the cathode of the LED group $\mathbf{20}_3$ directly to the current source 25. The LED group $\mathbf{20}_4$ is driven no more, and the rectified input voltage $V_{REC}$ could keep the LED groups $\mathbf{20}_1$, $\mathbf{20}_2$ and $\mathbf{20}_3$ illuminating if it exceeds the summation of the forward voltages of the LED groups $\mathbf{20}_1$, $\mathbf{20}_2$ and $\mathbf{20}_3$.

The AC LED lamp 200 includes a power bank 104 coupled between the rectified input voltage $V_{REC}$ and the ground voltage. The power bank stores electric energy when the absolute value of the sinusoid input voltage $V_{AC}$ is relatively high, and is expected to release its stored energy to the LED string when the absolute value of the sinusoid input voltage $V_{AC}$ is relatively low. The power bank 104 has a diode 114 connected between the node REC and the capacitor 112. When the rectified input voltage $V_{REC}$ exceeds the capacitor voltage $V_{CAP}$ of the capacitor 112, a current conducted through the diode 114 charges the capacitor 112, and the capacitor voltage $V_{CAP}$ increases. A PNP BJT 110 acts as a discharge switch, connected between the rectified input voltage $V_{REC}$ and the capacitor 112. When there is a non-zero control current $I_{CTL}$ draining away from the base of the BJT 110 and the capacitor voltage $V_{CAP}$ is higher than the rectified input voltage $V_{REC}$, the BJT 110 can conduct a charge current $I_{DIS}$ from the capacitor 112 to the node REC, powering the LED string. In other words, the BJT 110 can be turned on by the control current $I_{CTL}$, and then the energy stored in the capacitor 112 could be released to make one of the LED groups $\mathbf{20}_1$, $\mathbf{20}_2$, $\mathbf{20}_3$ and $\mathbf{20}_4$ illuminate. The control current $I_{CTL}$ exists only during a connection period $T_{CONN}$. As to when the connection period $T_{CONN}$ starts and ends, it is up to the control of the bank controller 206 inside the integrated circuit 202.

In FIG. 2, the bank controller 206 has a switch driver 209, a power-bad detector 203, and a power-good detector 204. The switch driver 209 manipulates the control current $I_{CTL}$ to control the BJT 110. In response to a first path signal corresponding to a first conduction path, the power-bad detector 203 detects when the magnitude of the input voltage $V_{AC}$ is considered to be low, so as to trigger the switch driver 209 and turn on the BJT 110. In response to a second path signal corresponding to a second conduction path, the power-good detector 204 detects when the magnitude of the input voltage $V_{AC}$ looks large enough, so as to trigger the switch driver 209 and turn off the BJT 110. Generally speaking, the power-bad detector 203 could determine the beginning of the connection period $T_{CONN}$, and the power-good detector 204 the end of the connection period $T_{CONN}$.

The switch driver 209 includes a switch 116, a current source 118, a SR register 208, a pulse generator 207, and some logic gates. When the SR register 208 asserts the signal $S_{CONN}$ at its output, the switch 116 is turned on and the constant current source 118 drains to form the control current $I_{CTL}$ away from the base of the BJT 110, turning on the BJT 110. When the SR register 208 deasserts the signal $S_{CONN}$, the control current $I_{CTL}$ stops and the BJT 110 is turned off, concluding the connection period $T_{CONN}$. The pulse generator 207 generates a pulse with a pulse width of a blanking time $T_{BLNK}$ right after the signal $S_{CONN}$ is asserted. That pulse, when appearing, prevents the SR register 208 from being reset. Derivable from FIG. 2, the switch driver 209 is configured to be prohibited from turning off the BJT 110 during the blanking time $T_{BLNK}$ after the BJT 110 is turned on. In other words, the connection period $T_{CONN}$ is constrained not to be less than the blanking time $T_{BLNK}$ set by the pulse generator 207.

A path signal corresponding to a conduction path could be a signal representing the current flowing through the conduction path, or a signal that turns on or off a path switch controlling the conduction path, or a terminal voltage at one terminal of the path switch connecting to a corresponding LED group. For example, a current-sense signal $SI_{P1}$, as shown in FIG. 2, representing the conduction current $I_{P1}$ through the conduction path $CP_1$, is a path signal corresponding to the conduction path $CP_1$, where the current-sense signal $SI_{P1}$ is generated by sensing the conduction current $I_{P1}$. The terminal voltage $SD_{P2}$ at the terminal of the path switch $SG_2$ connecting to LED group $\mathbf{20}_2$ is a path signal corresponding to the conduction path $CP_2$. The signal $S_3$ that turns on or off the path switch $SG_3$ is a path signal corresponding to the conduction path $CP_3$.

The power-bad detector 203 and the power-good detector 204 could act in response to two different path signals respectively. In one embodiment, these two different path signals could be related to different conduction paths respectively. In another embodiment, these two different path signals could be related to the same conduction path.

Figure 3:
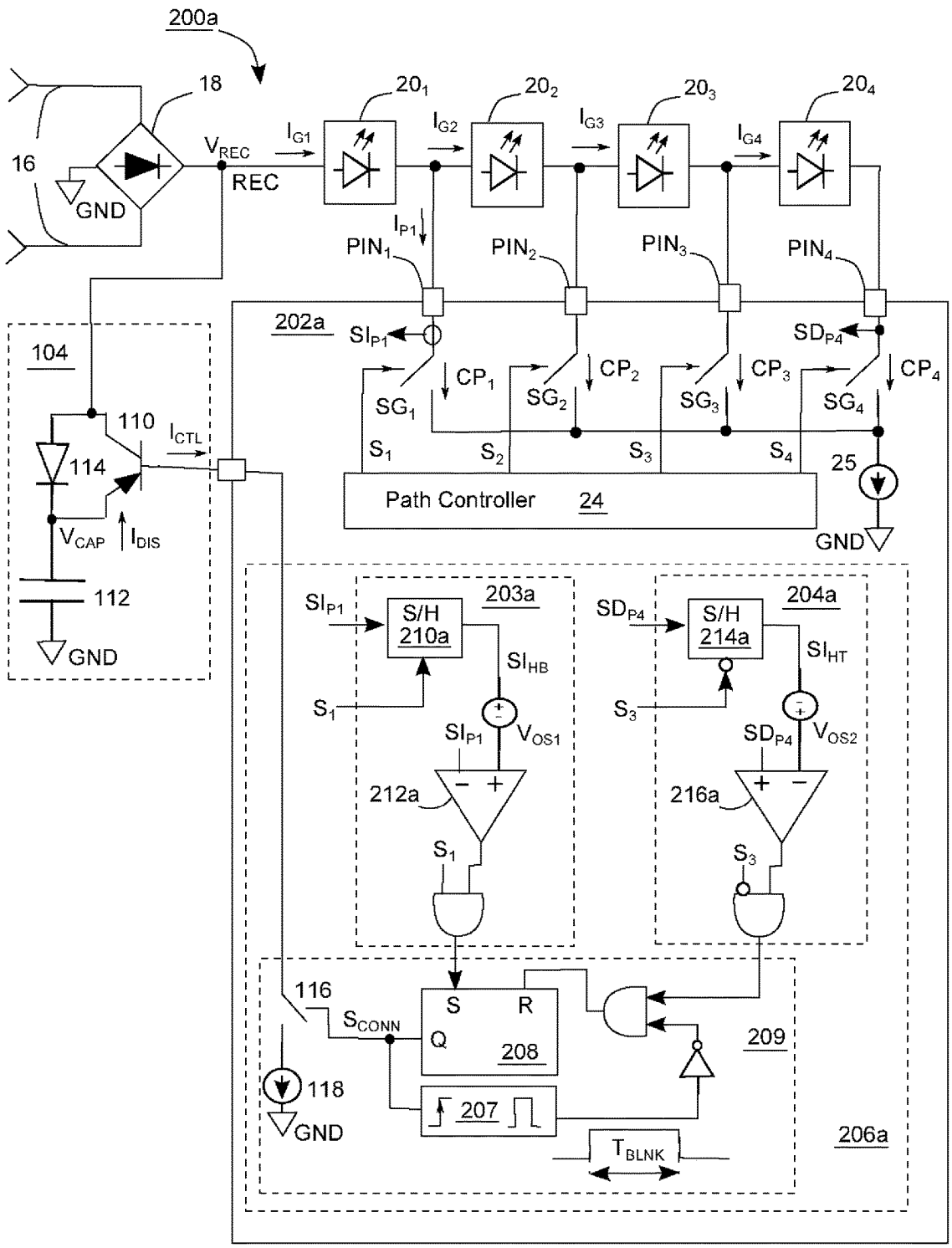

FIG. 3 demonstrates an AC LED lamp **200*a* according to embodiments of the invention. The power-bad detector 203*a* and the power-good detector 204*a* in the integrated circuit 202*a* of FIG. 3 are examples of the power-bad detector 203 and the power-good detector 204 in FIG. 2** respectively.

The power-bad detector 203*a* functions to detect whether the rectified input voltage $V_{REC}$ hardly makes the LED group $\mathbf{20}_1$ illuminate. A sample/hold circuit 210*a* samples the current-sense signal $SI_{P1}$ when the signal $S_1$ is deasserted, and holds a sample $SI_{HB}$ when the signal $S_1$ is asserted. In other words, the current-sense signal $SI_{P1}$, at the moment when the signal $S_1$ turns into being asserted, is sampled and held to be the sample $SI_{HB}$. A comparator 212*a* compares the current-sense signal $SI_{P1}$ with the sample $SI_{HB}$ minus an offset voltage $V_{OS1}$. If the signal $S_1$ turns on the path switch $SG_1$ and the current-sense signal $SI_{P1}$ is below the sample $SI_{HB}$ minus the offset voltage $V_{OS1}$, the output of the comparator 212*a* sets the SR register 208 in the switch driver 209, turning on the BJT 110 and starting the connection period $T_{CONN}$. The asserting of the signal $S_1$ means that the rectified input voltage $V_{REC}$ has decreased to a certain low level that is unable to keep both the LED groups $\mathbf{20}_1$ and $\mathbf{20}_2$ illuminating, so the signal $S_1$ is asserted to turn on the path switch $SG_1$, making the current $I_{G1}$ become the conduction current $I_{P1}$. Meanwhile, the conduction current $I_{P1}$ bypasses the LED group $\mathbf{20}_2$, leaving only the LED group $\mathbf{20}_1$ driven to illuminate. The sample $SI_{HB}$ from the sample/hold circuit 210*a* is the current-sense signal $SI_{P1}$ when the path switch $SG_1$ is just turned on, representing the normal amplitude of the conduction current $I_{P1}$ when only the LED group $\mathbf{20}_1$ illuminates. If the rectified input voltage $V_{REC}$ continues decreasing and is about unable to make the LED group $\mathbf{20}_1$ illuminate, the conduction current $I_{P1}$ first drops down below that normal amplitude, the current-sense signal $SI_{P1}$ becomes less than the sample $SI_{HB}$ minus the offset voltage $V_{OS1}$, so the comparator 212*a* starts the connection period $T_{CONN}$, during which the electric energy stored in the capacitor 112 is released to power the LED string, keeping at least one of the LED groups illuminating. Accordingly, the power-bad detector 203*a* functions to detect whether the rectified input voltage $V_{REC}$ drops and is about unable to make mere the LED group $\mathbf{20}_1$ illuminate. In one perspective, the power-bad detector 203*a* turns on the BJT 110 when the current-sense signal $SI_{P1}$ indicates that the rectified input voltage $V_{REC}$ has a negative slop and hardly makes the LED group $\mathbf{20}_1$ illuminate.

The power-good detector 204*a* functions to detect whether the rectified input voltage $V_{REC}$ is having a positive slope. A sample/hold circuit 214*a* samples the terminal voltage $SD_{P4}$ when the signal $S_3$ is asserted, and holds a sample $SI_{HT}$ when the signal $S_3$ is deasserted. In other words, the terminal voltage $SD_{P4}$, at the moment when the signal $S_3$ starts turning off the path switch $SG_3$, is sampled to be the sample $SI_{HT}$. If the signal $S_3$ turns off the path switch $SG_3$ and the terminal voltage $SD_{P4}$ exceeds the sample $SI_{HT}$ plus an offset voltage $V_{OS2}$, the output of the comparator 216*a* could reset the SR register 208 in the switch driver 209, turning off the BJT 110 and concluding the connection period $T_{CONN}$. The deasserting of the signal $S_3$ implies that the rectified input voltage $V_{REC}$ has arisen high enough to make all the LED groups $\mathbf{20}_1$, $\mathbf{20}_2$, $\mathbf{20}_3$ and $\mathbf{20}_4$ illuminate. The terminal voltage $SD_{P4}$ is having a positive slope if it exceeds the sample $SI_{HT}$ plus an offset voltage $V_{OS2}$. Please note that the terminal voltage $SD_{P4}$ varies following the variation of the rectified input voltage $V_{REC}$, or is equal to the rectified input voltage $V_{REC}$ minus the forward voltage of the LED string (including all the LED groups). Once the terminal voltage $SD_{P4}$ has a positive slope, the rectified input voltage $V_{REC}$ does too, meaning the input voltage $V_{AC}$ across the input port 16 has had a magnitude exceeding the capacitor voltage $V_{CAP}$ on the capacitor 112, and is pulling up the rectified input voltage $V_{REC}$. Since the input voltage $V_{AC}$ has become vital enough to pull up the rectified input voltage $V_{REC}$, the power bank 104 is unnecessary to power the LED string anymore, so the power-good detector 204*a* could trigger the switch driver 209 to turn off the BJT 110 and conclude the connection period $T_{CONN}$.

Even though the power-bad detector 203*a* responds to the path signals corresponding to the conduction path $CP_1$, this invention is not limited to however. Some embodiments of the invention could alter the power-bad detector 203*a* to respond to the path signals corresponding to the conduction path $CP_2$ for example. Similarly, this invention is not limited to the power-good detector 204*a* which responds to the path signals corresponding to the conduction paths $CP_3$ and $CP_4$. An embodiment of the invention could have a power-good detector generated by altering the power-good detector 204*a* to respond to the path signals corresponding to the conduction paths $CP_2$ and $CP_3$, for example.

Figure 4:
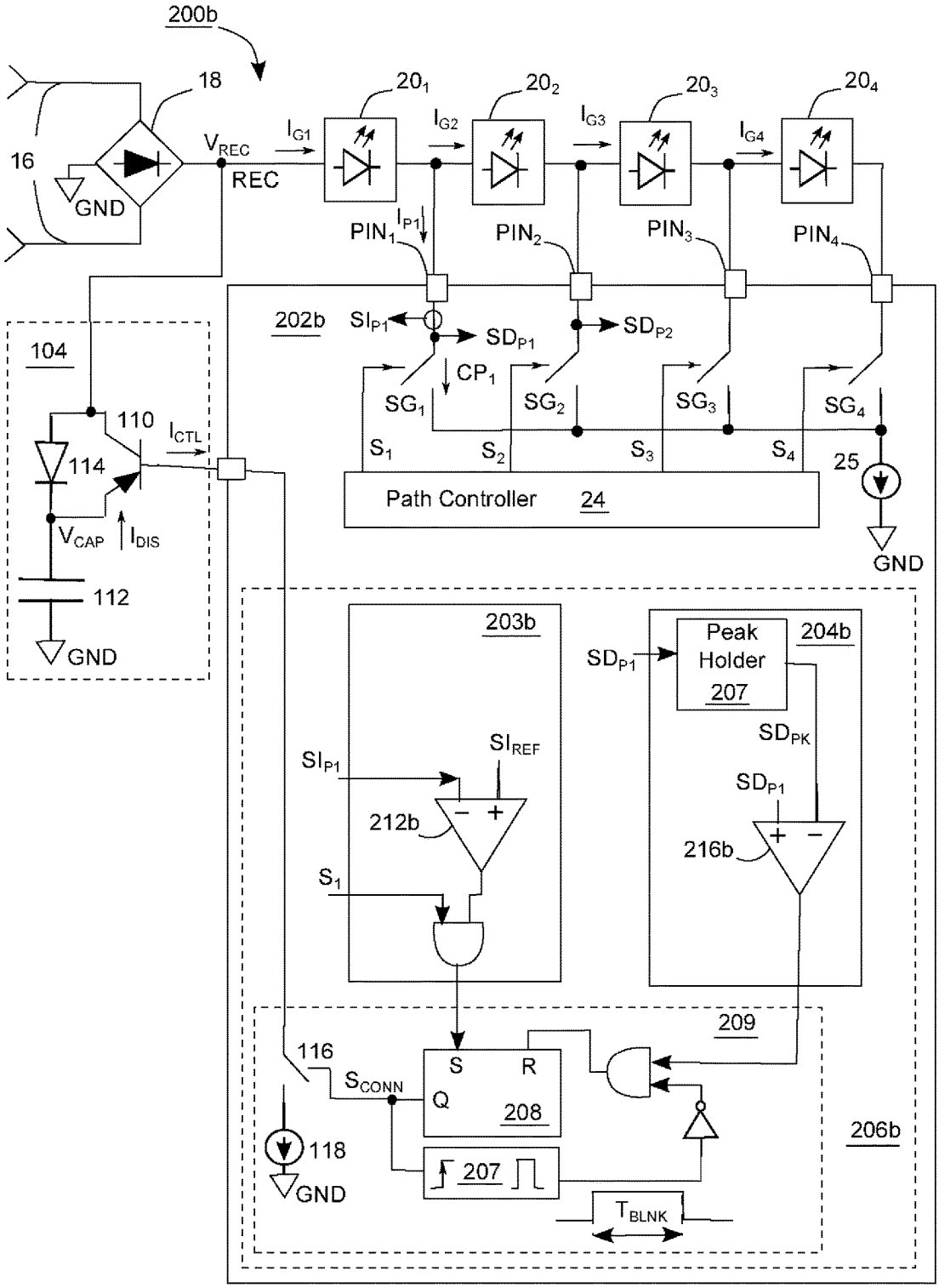

FIG. 4 demonstrates an AC LED lamp 200*b* according to embodiments of the invention, including an integrated circuit 202*b* with a bank controller 206*b*. The power-bad detector 203*b* and the power-good detector 204*b* in the bank controller 206*b* of FIG. 4 are examples of the power-bad detector 203 and the power-good detector 204 in FIG. 2 respectively. The path signals that the power-bad detector 203*b* and the power-good detector 204*b* respond to are all related to the conduction path $CP_1$.

The power-bad detector 203*b* functions to detect whether the rectified input voltage $V_{REC}$ hardly makes the LED group $\mathbf{20}_1$ illuminate. A comparator 212*b* compares the current-sense signal $SI_{P1}$ with a reference signal $SI_{REF}$. The reference signal $SI_{REF}$ could be a constant, representing the current magnitude of the current source 25 when only the LED group $\mathbf{20}_1$ illuminates properly. If the signal $S_1$ turns on the path switch $SG_1$ and the current-sense signal $SI_{P1}$ is below the reference signal $SI_{REF}$, the output of the comparator 212*b* sets the SR register 208 in the switch driver 209, turning on the BJT 110 and starting the connection period $T_{CONN}$. If the rectified input voltage $V_{REC}$ is about unable to make the LED group $\mathbf{20}_1$ illuminate, the conduction current $I_{P1}$ first drops down below the one that the current source 25 provides, the current-sense signal $SI_{P1}$ becomes less than the reference signal $SI_{REF}$, so the comparator 212*b* starts the connection period $T_{CONN}$, during which the electric energy stored in the capacitor 112 is released to power the LED string, keeping at least one of the LED groups illuminating. Accordingly, the power-bad detector 203*b* functions to detect whether the rectified input voltage $V_{REC}$ falls and hardly makes mere the LED group $\mathbf{20}_1$ illuminate.

The power-good detector 204*b* functions to detect whether the rectified input voltage $V_{REC}$ is about at a peak. The power-good detector 204*b* has a peak holder 207 and a comparator 216*b*. A peak of the terminal voltage $SD_{P1}$ is traced by the peak holder 207, which according outputs a reference voltage $SD_{PK}$ slightly less than the peak. Once the terminal voltage $SD_{P1}$ has exceeded the reference voltage $SD_{PK}$, the terminal voltage $SD_{P1}$ is about at the peak or its maximum, so the comparator 216*b* signals the switch driver 209, which in response turns off the BJT 110 after the blanking time $T_{BLNK}$, concluding the connection period $T_{CONN}$. The rectified input voltage $V_{REC}$ reaches its own maximum at the same time when the terminal voltage $SD_{P1}$ is at the peak of the terminal voltage $SD_{P1}$. As the connection period $T_{CONN}$ is concluded when the rectified input voltage $V_{REC}$ is about at its own maximum, the capacitor 112 is prevented from being uselessly discharged when the rectified input voltage $V_{REC}$ starts falling from its own maximum later on.

Both the power-bad detector 203*b* and the power-good detector 204*b* respond to the path signals corresponding to the conduction path $CP_1$, but this invention is not limited to however. Some embodiments of the invention could alter both the power-bad detector 203*b* and the power-good detector 204*b* to respond to the path signals corresponding to the conduction path $CP_2$ for example. In other embodiments of the invention, the power-bad detector 203*b* remains to respond to the current-sense signal $SI_{P1}$ and the signal $S_1$, while the power-good detector 204*b* is altered to respond to the terminal voltage $SD_{P2}$ for example.

Figure 5:
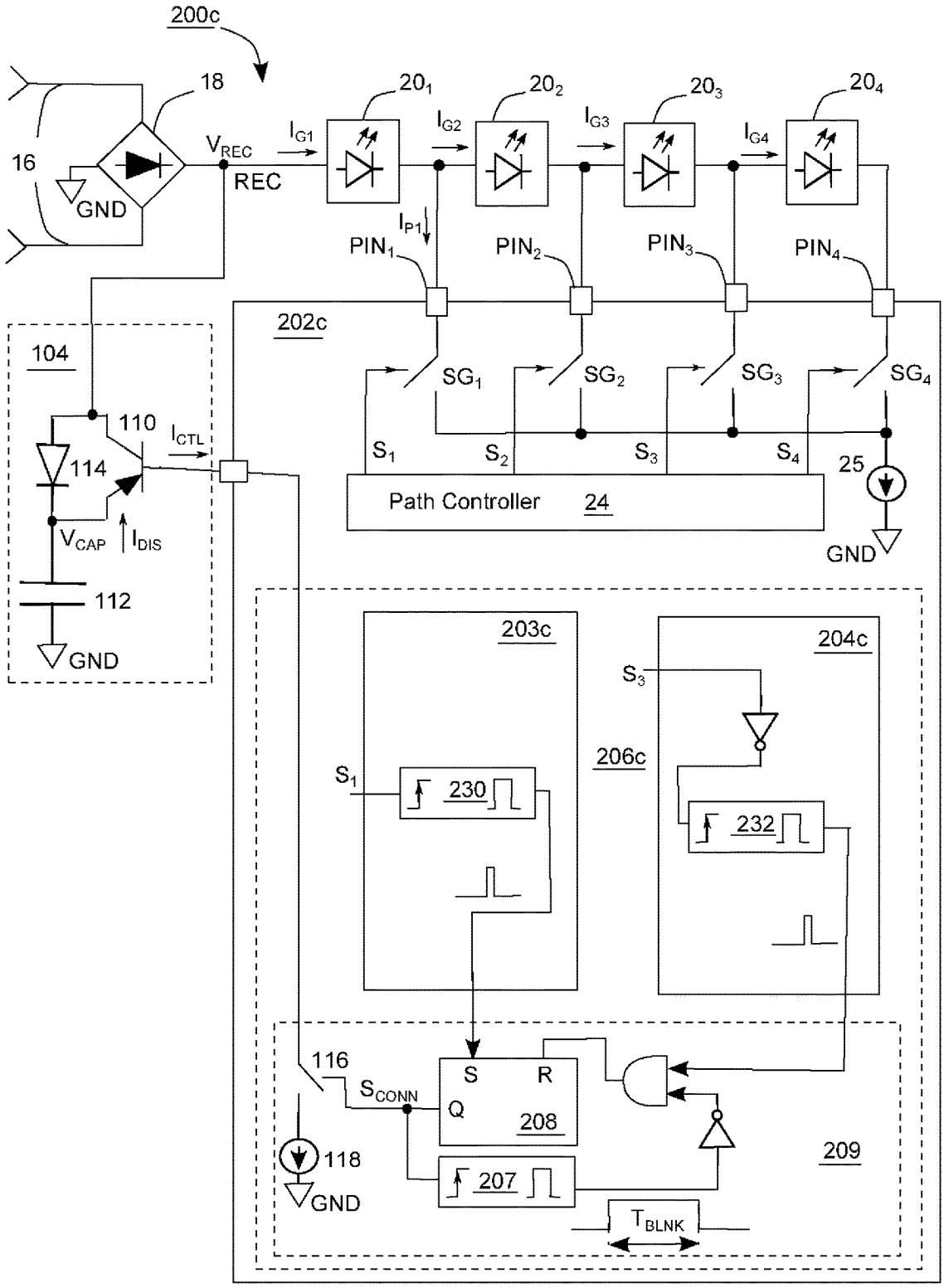

FIG. 5 demonstrates an AC LED lamp 200*c* according to embodiments of the invention, having an integrated circuit 202*c* with a bank controller 206*c*. The power-bad detector 203*c* and the power-good detector 204*c* in FIG. 5 are examples of the power-bad detector 203 and the power-good detector 204 in FIG. 2 respectively.

The power-bad detector 203*c* detects whether the rectified input voltage $V_{REC}$ cannot sustain the LED groups $\mathbf{20}_1$ and $\mathbf{20}_2$ to illuminate. The power-bad detector 203*c* signals the switch driver 209 to start the connection period $T_{CONN}$ when the signal $S_1$ is asserted, where the pulse generator 230 outputs a short pulse when finding a rising edge at its input. As aforementioned, the asserting of the signal $S_1$ implies that the rectified input voltage $V_{REC}$ has dropped to a certain level that cannot make both the LED groups $\mathbf{20}_1$ and $\mathbf{20}_2$ illuminate. Accordingly, the asserting of the signal $S_1$ can be used as an indication that the rectified input voltage $V_{REC}$ is about too low and that the capacitor 112 should start releasing the stored energy to power the LED string.

The power-good detector 204*c* detects whether the rectified input voltage $V_{REC}$ arises high enough to make all the LED groups $\mathbf{20}_1$, $\mathbf{20}_2$, $\mathbf{20}_3$ and $\mathbf{20}_4$ illuminate. The power-good detector 204*c* signals the switch driver 209 to possibly conclude the connection period $T_{CONN}$ when the signal $S_3$ is deasserted, where the pulse generator 232 outputs a short pulse when finding a rising edge at its input. The deasserting of the signal $S_3$ implies that the rectified input voltage $V_{REC}$ has arisen to a certain level that can make the LED groups $\mathbf{20}_1$, $\mathbf{20}_2$, $\mathbf{20}_3$ and $\mathbf{20}_4$ illuminate. Accordingly, the deasserting of the signal $S_3$ can be used as an indication that the rectified input voltage $V_{REC}$ is being raised by a vital input voltage $V_{AC}$ across the input port 16 and that the capacitor 112 could stop releasing the stored energy.

The power-bad detector 203*c* and the power-good detector 204*c*, individually or in combination, could be altered to respond to other path signals shown in FIG. 5.

Figure 6A:
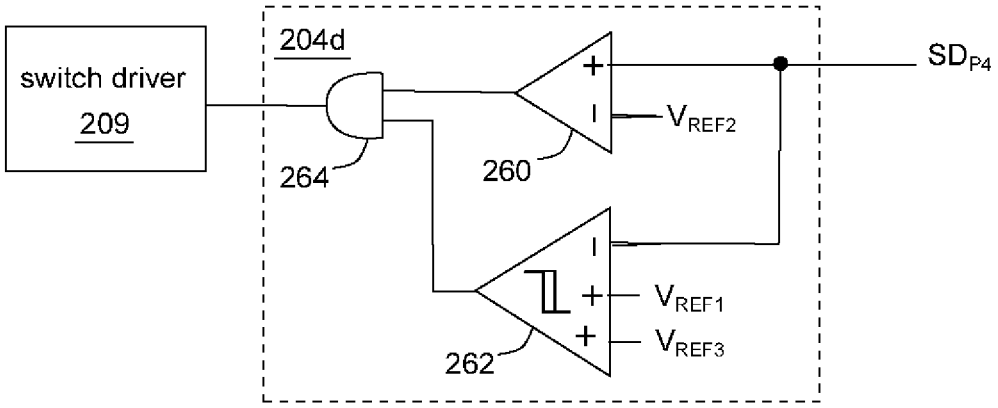
FIG. 6A shows a power-good detector.
Figure 6B:
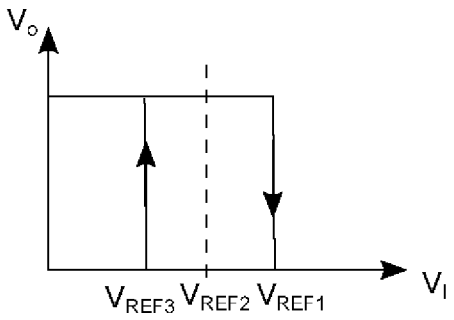
FIG. 6B demonstrates the transfer characteristic of the hysteresis comparator in FIG. 6A.

FIG. 6A shows a power-good detector 204*d*, which could replace any one of the aforementioned power-good detectors. The power-good detector 204*d* acts as a positive-slope detector, including a comparator 260, a hysteresis comparator 262 and a AND gate 264. FIG. 6B demonstrates the transfer characteristic of the hysteresis comparator 262 along with the reference voltages $V_{REF1}$, $V_{REF2}$ and $V_{REF3}$. The reference voltage $V_{REF1}$ is the largest among the reference voltages $V_{REF1}$, $V_{REF2}$ and $V_{REF3}$, while the reference voltage $V_{REF3}$ the smallest. In view of the configuration of the power-good detector 204*d* in FIG. 6A and the transfer characteristic of FIG. 6B, it can be derived that the AND gate 264 has an output logic value of "1" only if the terminal voltage $SD_{P4}$ has been below the reference voltage $V_{REF3}$ and now arises to be between the reference voltages $V_{REF1}$ and $V_{REF2}$, meaning, in other words, that the terminal voltage $SD_{P4}$ currently has a positive slope. As the capacitor 112, during discharging, can contribute only a negative slope to the terminal voltage $SD_{P4}$, the occurrence of the positive slope of the terminal voltage $SD_{P4}$ could be an indication that the AC input voltage $V_{AC}$ across the input port 16 is now pulling up the rectified input voltage $V_{REC}$. Accordingly, the capacitor 112 could be stopped from releasing the stored energy when the power-good detector 204*d* finds a positive slope of the terminal voltage $SD_{P4}$.

In embodiments of the invention, the power-good detector 204*d* could be altered to respond to terminal voltage $SD_{P1}$, $SD_{P2}$ or $SD_{P3}$.

All the aforementioned power-good detectors are interchangeable to form different embodiments, so are all the aforementioned power-bad detectors. For example, one embodiment according to the invention could have the power-good detector 204*a* and the power-bad detector 203*b* for determining the end and the beginning of the connection period $T_{CONN}$ respectively.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An integrated circuit, suitable for an LED lamp comprising a power bank and LED groups, wherein the power bank is coupled between a rectified input voltage and a ground voltage, the power bank comprising a capacitor storing electric energy and a discharge switch coupled between the capacitor and the rectified input voltage, and the LED groups are arranged in series between the rectified input voltage and the ground voltage, the integrated circuit comprising:

a path controller configured to control conduction paths, each conduction path coupling a corresponding LED group to the ground voltage; and a bank controller, configured to turn on the discharge switch in response to a first path signal corresponding to a first conduction path, and to turn off the discharge switch in response to a second path signal corresponding to a second conduction path;

wherein the first and second path signals are different from each other.

2. The integrated circuit of claim 1, wherein the bank controller comprises:

a switch driver, for controlling the discharge switch;

a power-bad detector, for triggering the switch driver to turn on the discharge switch in response to the first path signal; and a power-good detector, for triggering the switch driver to turn off the discharge switch in response to the second path signal.

3. The integrated circuit of claim 2, wherein the switch driver is configured to be prohibited from turning off the discharge switch a blanking time after turning on the discharge switch.

4. The integrated circuit of claim 2, wherein the power-bad detector turns on the discharge switch when the first path signal corresponding to the first path switch indicates the rectified input voltage has a negative slope.

5. The integrated circuit of claim 2, wherein the first conduction path couples a first LED group to the ground voltage, and the power-bad detector turns on the discharge switch when the first path signal indicates that the rectified input voltage hardly makes the first LED group illuminate.

6. The integrated circuit of claim 2, wherein the power-good detector turns off the discharge switch when the second path signal indicates the rectified input voltage has a positive slope.

7. The integrated circuit of claim 2, wherein the power-good detector turns off the discharge switch when the second path signal indicates the rectified input voltage is about at a peak.

8. The integrated circuit of claim 1, wherein the first conduction path is the second conduction path.

9. The integrated circuit of claim 1, wherein the first and second conduction paths couple first and second LED groups to the ground voltage respectively, and the first LED group is an upstream LED group in respect to the second LED group.

10. The integrated circuit of claim 1, wherein the first path signal is a signal representing a current flowing through the first conduction path.

11. The integrated circuit of claim 1, wherein the first path signal is a signal turning on or off a first path switch controlling the first conduction path.

12. The integrated circuit of claim 1, wherein the path controller comprises a first path switch controlling the first conduction path, the first path switch has one terminal connected to a first LED group, and the first path signal is at the terminal.

13. A control method suitable for an LED lamp comprising a power bank and LED groups, wherein the power bank is coupled between a rectified input voltage and a ground voltage, the power bank comprising a capacitor storing electric energy and a discharge switch coupled between the capacitor and the rectified input voltage, and the LED groups are arranged in series between the rectified input voltage and the ground voltage, the control method comprising:

providing conduction paths, each coupling a corresponding LED group to the ground voltage;

turning on the discharge switch in response to a first path signal corresponding to a first conduction path among the conduction paths, so as to release the electric energy to power the LED groups; and turning off the discharge switch in response to a second path signal corresponding to a second conduction path among the conduction paths, so as to stop the capacitor from releasing the electric energy;

wherein the first and second path signals are different from each other.

14. The control method of claim 13, comprising:

prohibiting the discharge switch from being turned off a blanking time after turning on the discharge switch.

15. The control method of claim 13, the first and second conduction paths couple first and second LED groups to the ground voltage respectively, and the first LED group is an upstream LED group in respect to the second LED group.

16. The control method of claim 13, wherein the first conduction path is the second conduction path.

17. The control method of claim 13, wherein the step of turning on the discharge switch comprises:

sampling the first path signal to hold a sample; and comparing the first path signal with the sample to turn on the discharge switch.

18. The control method of claim 13, wherein the step of turning off the discharge switch comprises:

sampling the second path signal to hold a sample; and comparing the second path signal with the sample to turn off the discharge switch.

19. The control method of claim 13, wherein one of the first and second path signals is a signal representing a current flowing through a corresponding conduction path.

20. The control method of claim 13, wherein one of the first and second path signals is a signal turning on or off a path switch controlling a corresponding conduction path.

21. The control method of claim 13, wherein one of the first and second path signals is a signal at a terminal of a path switch, and the terminal connects the path switch to one of the LED groups.

* * * * *